US011015285B2

(12) United States Patent
Garrone et al.

(10) Patent No.: US 11,015,285 B2
(45) Date of Patent: May 25, 2021

(54) FEEDING DEVICE AND METHOD FOR FEEDING A FLATWORK TEXTILE ARTICLE TO A LAUNDRY TREATMENT APPARATUS

(71) Applicant: GIRBAU ROBOTICS, Aix les Bains (FR)

(72) Inventors: Dominique Garrone, Aix les Bains (FR); Felix Mouton, Chambery (FR); Sylvain Duplouy, Brison Saint Innocent (FR)

( * ) Notice: Subject to any disclaimer, the term of this patent is extended or adjusted under 35 U.S.C. 154(b) by 148 days.

(21) Appl. No.: 16/458,635

(22) Filed: Jul. 1, 2019

(65) Prior Publication Data

US 2020/0181831 A1 Jun. 11, 2020

(30) Foreign Application Priority Data

Dec. 5, 2018 (EP) ..... 18382894

(51) Int. Cl.
*D06F 67/04* (2006.01)
*D06C 3/00* (2006.01)

(52) U.S. Cl.
CPC ..... *D06F 67/04* (2013.01); *D06C 3/00* (2013.01)

(58) Field of Classification Search
CPC ..... D06F 67/00; D06F 67/10; D06F 67/04; D06C 3/00
See application file for complete search history.

(56) References Cited

U.S. PATENT DOCUMENTS 4,979,868 A * 12/1990 Ueda ..... B61B 10/025 38/12
5,169,282 A * 12/1992 Ueda ..... D06F 67/04 38/7
5,440,810 A * 8/1995 Borucki ..... D06F 67/04 38/143
5,515,627 A * 5/1996 McCabe ..... D06F 67/04 38/143
7,448,152 B2 * 11/2008 Jensen ..... D06F 67/04 38/143
9,222,213 B2 * 12/2015 Garrone ..... D06F 67/04

FOREIGN PATENT DOCUMENTS

WO WO 2018059730 A1 * 4/2018
WO WO 2019072751 A1 * 4/2019

* cited by examiner

*Primary Examiner* — Ismael Izaguirre
(74) *Attorney, Agent, or Firm* — Eugenio J. Torres-Oyola; Victor M. Rodriguez-Reyes; Rafael Rodriguez-Muriel

(57) ABSTRACT

The feeding device comprises a pair of clamp assemblies (3) arranged to grasp corner portions of two contiguous corners of a flatwork textile article (30) and to move along transverse guides in opposite directions to spread the flatwork textile article (30) for depositing it on a feed conveyor. Each clamp assembly comprises a main clamp (6) supported on a main support (5) and having a pair of main jaws (7) providing a first frictional force, and a secondary clamp (9) supported on a secondary support (8) and having a pair of secondary jaws (10) providing a higher second frictional force. The secondary support is movable relative to the main support between a position adjacent to the main clamp and a position distanced from the main clamp to reduce an article protruding corner portion (31) remaining at a first side (S1) of the main jaws (7) in a closed position.

10 Claims, 6 Drawing Sheets

FEEDING DEVICE AND METHOD FOR FEEDING A FLATWORK TEXTILE ARTICLE TO A LAUNDRY TREATMENT APPARATUS

TECHNICAL FIELD

The present invention relates in general to a feeding device and method for feeding a flatwork textile article to a laundry treatment apparatus, and more in particular to a feeding device and method making use of a pair of spreading clamp assemblies for grasping two contiguous corners of the flatwork textile article, and a repositioning device associated to each spreading clamp assembly for minimizing a protruding corner portion of the flatwork textile article remaining at one side of a clamping pinch of the spreading clamp assembly before the flatwork textile article is deposited to a feed conveyor.

The term "flatwork textile article" is used in this specification to mean flat pieces of cloth having a square or rectangular shape with four corners, such as sheets, pillowcases, towels, napkins, tablecloths, etc.

BACKGROUND OF THE INVENTION

In laundry treatment processes, flatwork textile articles are supplied by devices referred to as feeding machines to subsequent laundry treatment devices such as drying and/or ironing machines. During the feed process carried out by the feeding machines, two contiguous corners of the flatwork textile articles are transferred to spreading clamps and the spreading clamps are moved away from one another to stretch a front edge of the flatwork textile article before depositing the flatwork textile article onto a feed conveyor. In the process, protruding corner portions of the flatwork textile articles are usually formed at one side of a clamping pinch of the spreading clamps. Said protruding corner portions primarily give rise to so-called ear formations when the front edge of the flatwork textile article is stretched by the spreading clamps. Said ear formations negatively impact the quality of the flatwork textile article once transferred to the feed conveyor.

Document WO 2018059730 A1 discloses a feeding device and method for feeding a flatwork textile article to a laundry treatment apparatus, wherein the feeding device comprises a feed conveyor arranged to convey the spread flatwork textile article in a feed direction, transverse guides perpendicular to the feed direction arranged on a support structure, a pair of clamps coupled to the transverse guides, and driving elements connected to move the clamps along the transverse guides in opposite directions. Each clamp comprises a pair of jaws actuated to move between an open position and a closed position providing a clamping pinch to grasp a corner of the flatwork textile article. The jaws are provided with respective opposite rollers which provide the clamping pinch. One of the rollers is motorized to move the flatwork textile article through the jaws in the closed position in order to minimize a protruding corner portion of the flatwork textile article remaining at one side of the clamping pinch.

A drawback of the cited document WO 2018059730 A1 is that the opposite rollers of the jaws have to perform the function of providing the clamping pinch for grasping the corner portion of the flatwork textile article and simultaneously the function of moving the corner portion through the clamping pinch, which can produce an undesirable wrinkle ironing effect in the corner portion of the flatwork textile article.

Disclosure of the Invention

According to a first aspect, the present invention provides a feeding device for feeding a flatwork textile article to a laundry treatment apparatus which is an alternative solution with respect to the prior art.

The feeding device of the present invention comprises a feed conveyor arranged to convey a spread flatwork textile article in a feed direction, a support structure elongated in a transverse direction perpendicular to the feed direction, transverse guides arranged along the support structure, a pair of clamp assemblies coupled to the transverse guides and arranged to grasp corner portions of two contiguous corners of the flatwork textile article delivered thereto, and driving elements operatively connected to move the clamp assemblies along the transverse guides in opposite directions to spread the flatwork textile article in order to deposit it on the feed conveyor.

In the feeding device of the present invention, each clamp assembly comprises a main clamp support, a main clamp supported on the main clamp support, and a repositioning device which acts to minimize a protruding corner portion of the flatwork textile article remaining at a first side of a clamping pinch defined by the main jaws in the closed position before the spread flatwork textile article is deposited on the feed conveyor.

The main clamp has a pair of main jaws actuated to move between an open position and a closed position to grasp the corresponding corner portion of the flatwork textile article. The repositioning device comprises a secondary clamp support movably mounted to the main clamp support, a secondary clamp supported on the secondary clamp support, and a repositioning actuator arranged to move the secondary clamp support and the secondary clamp between a position adjacent to the main clamp and a position spaced apart from the main clamp. The secondary clamp has a pair of secondary jaws actuated to move between an open position and a closed position to grasp a nearby corner portion of the flatwork textile article located at an opposite second side of the clamping pinch of the main jaws in the closed position.

The clamp assembly is configured such that a first frictional force between the main jaws and the flatwork textile article is lower than a second frictional force between the secondary jaws and the flatwork textile article, at least during a repositioning operation.

Thus, by activating the repositioning actuator to locate the secondary clamp in the position adjacent to the main clamp and by actuating the secondary clamp to move the secondary jaws to the closed position, the secondary clamp grasps the nearby corner portion of the flatwork textile article. Then, by activating the repositioning actuator to move the secondary clamp with the grasped nearby corner portion of the flatwork textile article from the position adjacent to the main clamp to the position spaced apart from the main clamp, the nearby corner portion of the flatwork textile article is pulled and, by virtue of the first frictional force being lower than the second frictional force, the protruding corner portion of the flatwork textile article slips through the main jaws of the main clamp causing the protruding corner portion to be reduced or minimized to a desired extent.

In one embodiment, the main jaws of the main clamp are driven by a main clamp actuator, the secondary jaws of the secondary clamp are driven by a secondary clamp actuator, and a control device is connected to the main clamp actuator and/or to the secondary clamp actuator. The control device is configured to regulate a first clamping force exerted by the main clamp to provide the first frictional force and/or a second clamping force exerted by the secondary clamp to provide the second frictional force, at least during the repositioning operation.

In another embodiment, the main jaws of the main clamp comprise opposing first clamping elements and the secondary jaws of the secondary clamp comprise opposing second clamping elements. The first clamping elements are made of a first material and/or have a first surface configuration which contributes to provide the first frictional force. The second clamping elements are made of a second material and/or have a second surface configuration which contributes to provide the second frictional force.

Regulation by the control device of the first and second clamping forces exerted by the main and secondary clamps can be combined with the materials and/or surface configurations of the first and second clamping elements to provide the first and second frictional forces.

In a preferred embodiment, the main clamp actuator and the secondary clamp actuator are pneumatic actuators, although alternatively other actuators such as electric motors or solenoids can be used.

In a preferred embodiment, the secondary clamp support is connected to a guide follower coupled to a linear guide attached to the main clamp support. The linear guide may be oriented in the feed direction, in the transverse direction, in a direction perpendicular to the feed direction and to the transverse direction, or in a direction inclined with respect to one or more of the former. Alternatively, the secondary clamp support can be pivotally connected to the main clamp support about a pivot axis.

Preferably, the repositioning actuator is a pneumatic actuator, although alternatively another actuator such as an electric motor or a solenoid can be used.

According to a second aspect, the present invention provides a feeding method for feeding a flatwork textile article to a laundry treatment apparatus by using a feeding device according to the first aspect of the present invention.

The feeding method comprises the steps of grasping corner portions of two contiguous corners of a flatwork textile article by moving the main jaws of the main clamps to a closed position, spreading the flatwork textile article by moving the clamp assemblies in opposite directions along the transverse guides by means of the driving elements, depositing the spread flatwork textile article on the feed conveyor, and minimizing a protruding corner portion of the flatwork textile article remaining at a first side of a clamping pinch defined by the main jaws of each main clamp in the closed position by means of the repositioning device before the spread flatwork textile article is deposited on the feed conveyor.

In the feeding method of the present invention, the step of minimizing the protruding corner portion comprises grasping a nearby corner portion of the flatwork textile article located at an opposite second side of the clamping pinch of the main jaws of each main clamp by moving the secondary jaws of each secondary clamp to a closed position, providing a first frictional force between the main jaws and the flatwork textile article that is lower than a second frictional force between the secondary jaws and the flatwork textile article, moving the secondary clamp away from the main clamp by means of the repositioning actuator thereby making the protruding corner portion of the flatwork textile article to slip through the main jaws until the protruding corner portion of the flatwork textile article remaining at the first side of the clamping pinch of the main jaws is reduced to a desired extent, and moving the secondary jaws of the secondary clamp to an open position thereby releasing the nearby corner portion of the flatwork textile article located at the opposite second side of clamping pinch of the main jaws.

In one embodiment, the step of providing the first and second frictional forces comprises driving the main jaws of the main clamp by a main clamp actuator, driving the secondary jaws of the secondary clamp by a secondary clamp actuator, and regulating a first clamping force exerted by the main clamp actuator to provide the first frictional force by means of a control device at least during the repositioning operation, and/or regulating a second clamping force exerted by the secondary clamp actuator to provide the second frictional force by means of the control device at least during the repositioning operation.

In an alternative embodiment, the step of providing the first and second frictional forces comprises providing the main jaws of the main clamp with opposing first clamping elements made of a first material and/or having a first surface configuration which contributes to provide the first frictional force, and providing the secondary jaws of the secondary clamp with opposing second clamping elements made of a second material and/or having a second surface configuration which contributes to provide the second frictional force.

BRIEF DESCRIPTION OF THE DRAWINGS

The foregoing and other features and advantages will be more fully understood from the following detailed description of an illustrative and non limiting embodiment with reference to the accompanying drawings, in which.

DETAILED DESCRIPTION OF A PREFERRED EMBODIMENT

Figure 1:
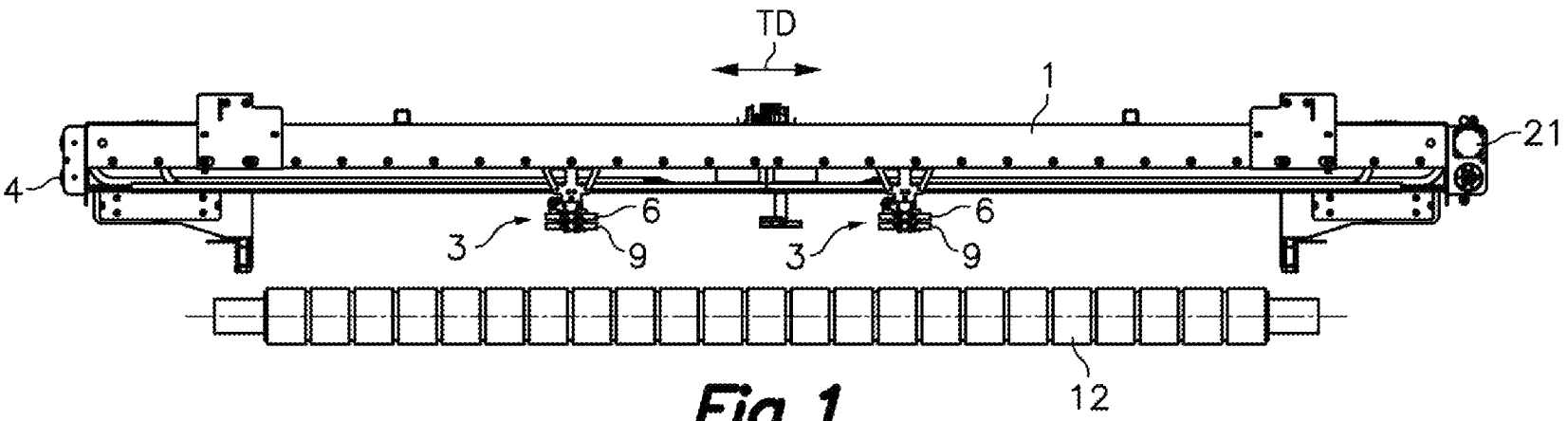
FIG. 1 is a front view of a feeding device according to an embodiment of the present invention including a pair of clamp assemblies.
Figure 2:
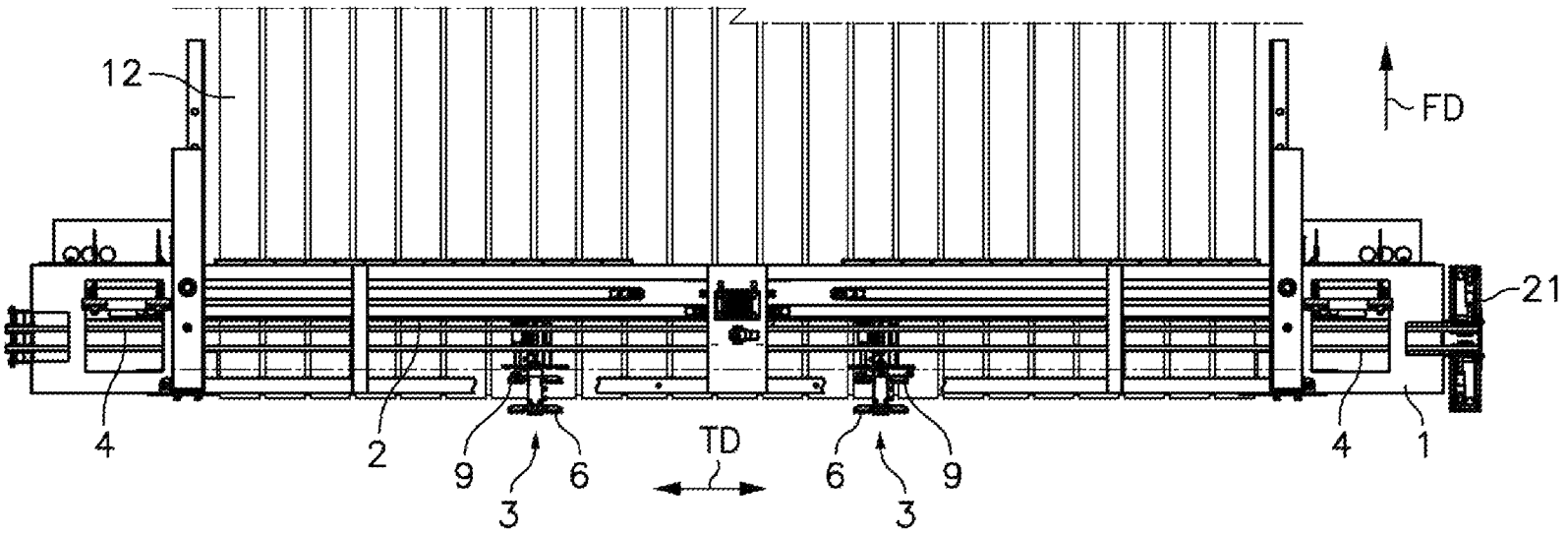
FIG. 2 is an upper plan view of the feeding device with cut-out parts to better show the clamp assemblies.
Figure 3:
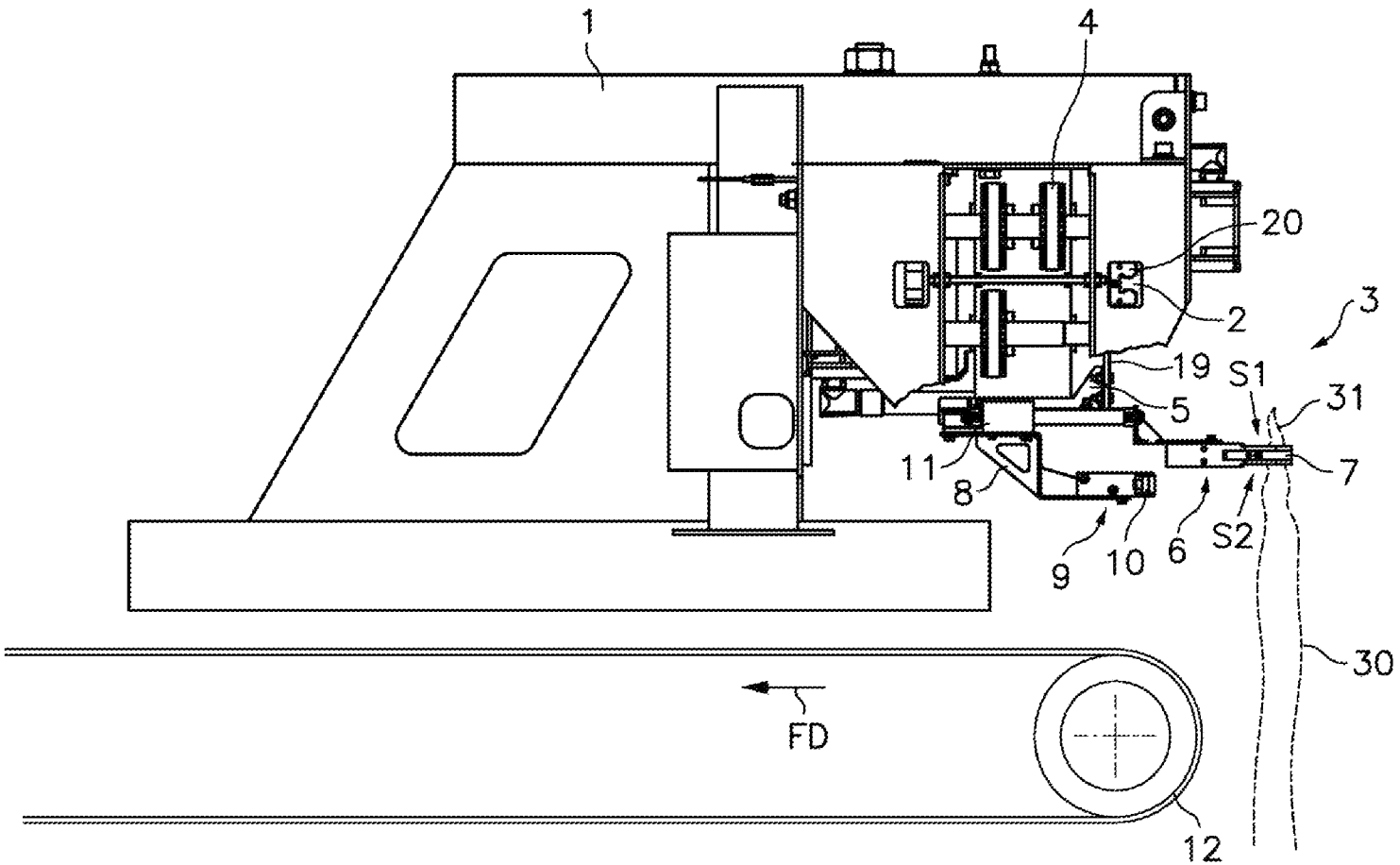
FIG. 3 is a side view of the feeding device with cut-out parts to better show one of the clamp assemblies grasping a corner portion of a flatwork textile article.
Figure 4:
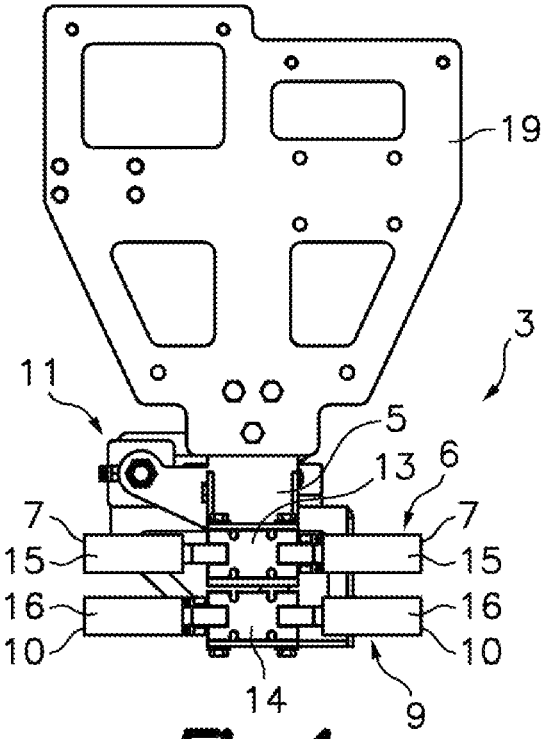
FIGS. 4, 5 and 6 are front, upper and side views, respectively, of the clamp assembly with a secondary clamp in a position spaced apart from a main clamp and with clamping jaws in an open position.
Figure 5:
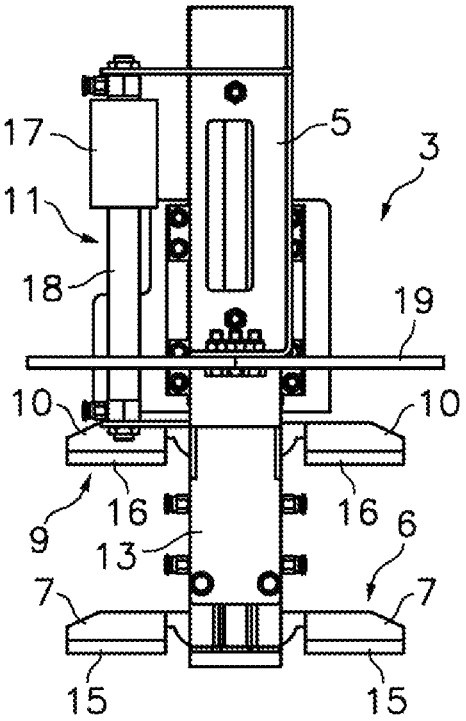
Figure 6:
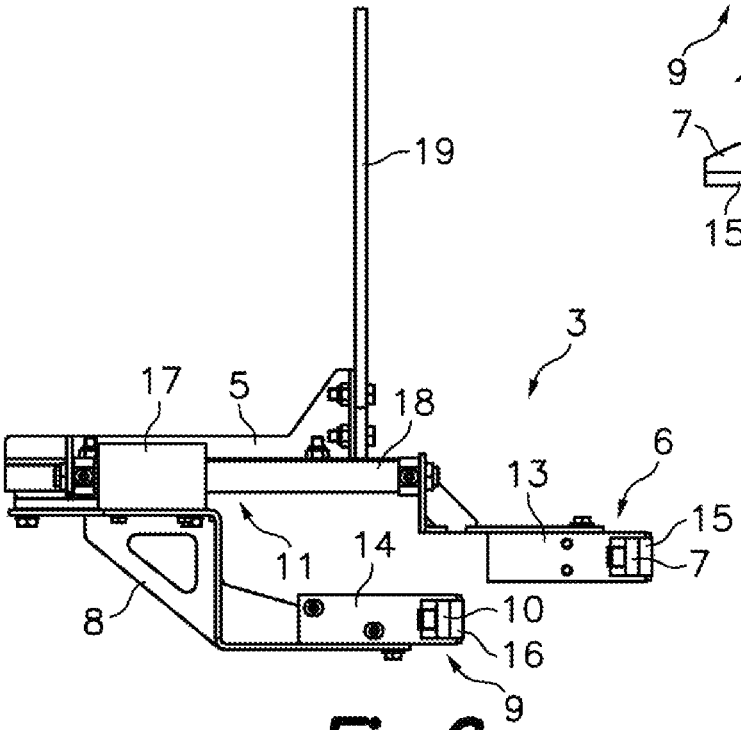

Referring first to FIGS. 1, 2 and 3, a feeding device according to an embodiment of the present invention is show. The feeding device is useful for feeding a flatwork textile article to a laundry treatment apparatus, and comprises a feed conveyor 12 installed in a framework (not shown) of a feeding machine and arranged to convey a spread flatwork textile article 30 in a feed direction FD, a support structure 1 mounted to the framework and transverse guides 2 arranged along the support structure 1. The support structure 1 is elongated in a transverse direction TD perpendicular to the feed direction FD and the transverse guides 2 are oriented in the transverse direction TD.

A pair of clamp assemblies 3 are coupled to the transverse guides 2 and arranged to grasp corner portions of two contiguous corners of the flatwork textile article 30 (FIG. 3). The corner portions of the flatwork textile article 30 are delivered to the clamp assemblies 3 either by movable loading clamps (not shown) of the feeding machine or manually.

The two clamp assemblies 3 are operatively connected to driving elements 4, such as movement transmission belts driven by one or more electric motors 21, which move the clamp assemblies 3 along the transverse guides 2 in opposite directions. The clamp assemblies 3 are first moved close to each other in a central region of the support structure to receive the corner portions of the flatwork textile article 30 an then are moved away from each other to spread the flatwork textile article 30 into a position ready to deposit it on the feed conveyor 12.

As better shown in FIGS. 4 to 9, each clamp assembly 3 comprises a main clamp support 5 and a main clamp 6 supported on the main clamp support 5. The main clamp support 5 includes a mounting plate 19 attached to a guide follower 20 coupled to the transverse guides 2. The mounting plate 19 is further connected to the driving elements 4.

Figure 7:
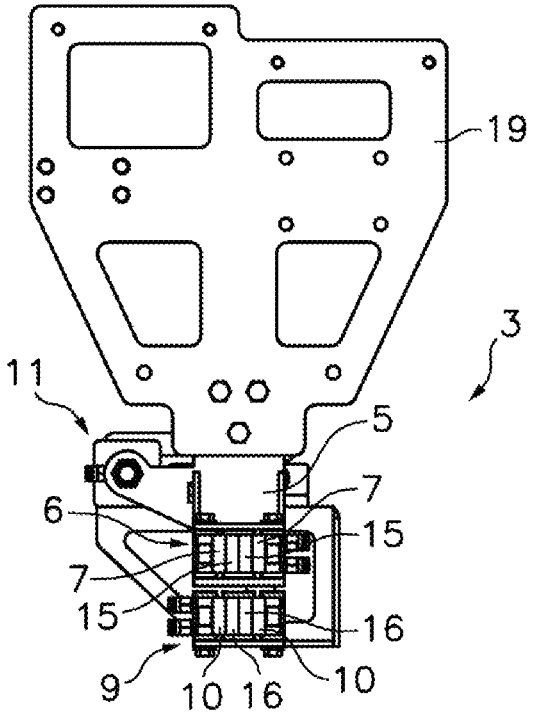
FIGS. 7, 8 and 9 are front, upper and side views, respectively, of the clamp assembly with the secondary clamp in a position adjacent to the main clamp and with the clamping jaws in a closed position.
Figure 8:
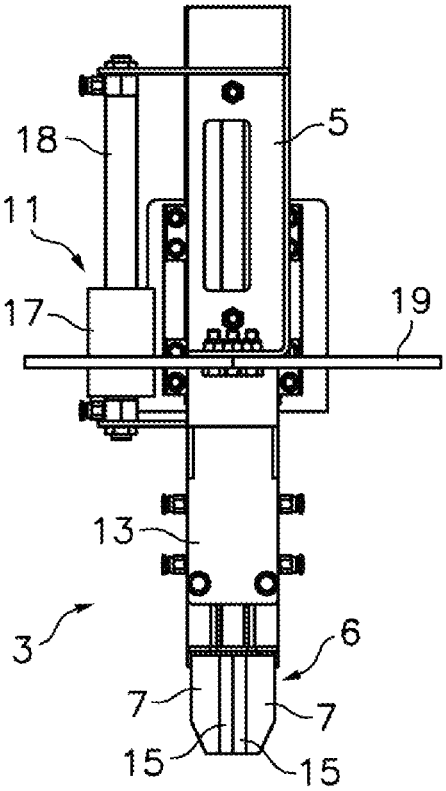
Figure 9:
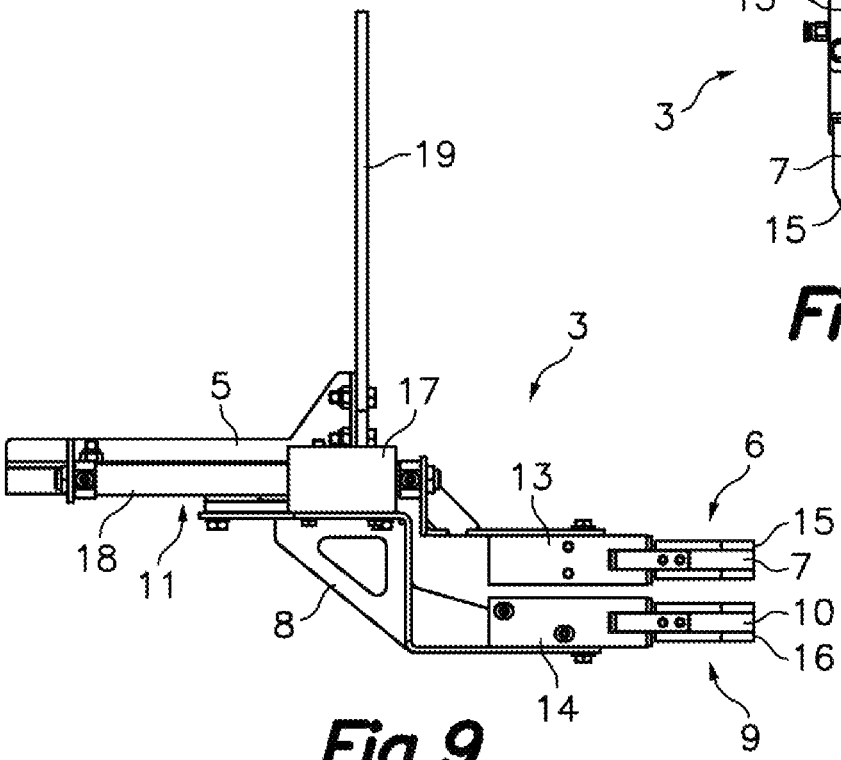

The main clamp 6 has a pair of main jaws 7 driven by a main clamp actuator 13 to move between an open position (FIGS. 4, 5 and 6) and a closed position (FIGS. 7, 8 and 9). The main jaws 7 of the main clamp 6 comprise opposing first clamping elements 15 made of a first material and/or having a first surface configuration. In the shown embodiment, the main clamp actuator 13 is a pneumatic actuator although in alternative embodiments the main clamp actuator 13 could be an electric motor or a solenoid.

Each clamp assembly 3 further comprises a repositioning device including a secondary clamp support 8 connected to a guide follower 17 coupled to a linear guide 18 attached to the main clamp support 5 and a secondary clamp 9 supported on the secondary clamp support 8. A repositioning actuator 11 is arranged to move the secondary clamp support 8 and the secondary clamp 9 with respect to the main clamp support 5 along the linear guide 18 between a position adjacent to the main clamp 6 (FIGS. 7, 8, 9, 10 and 11) and a position spaced apart from the main clamp 6 (FIGS. 2, 3, 4, 5, 6, 12 and 13). In the shown embodiment the repositioning actuator 11 is a pneumatic actuator including the guide follower 17 and the linear guide 18.

The secondary clamp 9 has a pair of secondary jaws 10 driven by a secondary clamp actuator 14 to move between an open position (FIGS. 4, 5 and 6) and a closed position (FIGS. 7, 8 and 9). The secondary jaws 10 of the secondary clamp 9 comprise opposing second clamping elements 16 made of a second material and/or having a second surface configuration. In the shown embodiment the secondary clamp actuator 14 is a pneumatic actuator although in alternative embodiments the secondary clamp actuator 14 could be an electric motor or a solenoid.

The main jaws 7 of the main clamp 6 in the closed position define a clamping pinch having a first side S1 (the upper side in the shown embodiment) and an opposite second side S2 (the lower side in the shown embodiment). The secondary jaws 10 of the secondary clamp 9 are located at the second side S2 when the secondary clamp 9 is in the position adjacent to the main clamp 6.

As will be explained below with reference to FIGS. 10-13, both the main clamp 6 and the secondary clamp 9 are configured and arranged to grasp different corner portions of a corner of the flatwork textile article 30. The clamp assembly 3 is configured such that a first frictional force between the main jaws 7 and the flatwork textile article 30 is lower than a second frictional force between the secondary jaws 10 and the flatwork textile article 30, at least during a repositioning operation.

For example, a control device (not shown) is connected to the main clamp actuator 13 and/or to the secondary clamp actuator 14. The control device is configured to regulate a first clamping force exerted by the main clamp 6 in order to provide the first frictional force at least during the repositioning operation. Alternatively or additionally the control device is configured to regulate a second clamping force exerted by the secondary clamp 9 in order to provide the second frictional force at least during the repositioning operation. For example, the control device may be a pressure regulator when the main and secondary clamp actuators 13, 14 are pneumatic actuators or a current or voltage regulator when the main and secondary clamp actuators 13, 14 are electric motors or solenoids.

Alternatively or additionally, the first material of which the first clamping elements 15 are made and/or the first surface configuration of the first clamping elements 15 provides a first friction coefficient that contributes to achieve the first frictional force, and/or the second material of which the second clamping elements 16 are made and/or the second surface configuration of the second clamping elements 16 provides a second friction coefficient that contributes to provide the second frictional force. For example, the first and second clamping elements 15, 16 may be made of strips of metal, rubber or plastic and the first and second surface configurations thereof may include a smooth or rough surface finishing and/or undulations, protrusions, grooves or other relieves.

Figure 10:
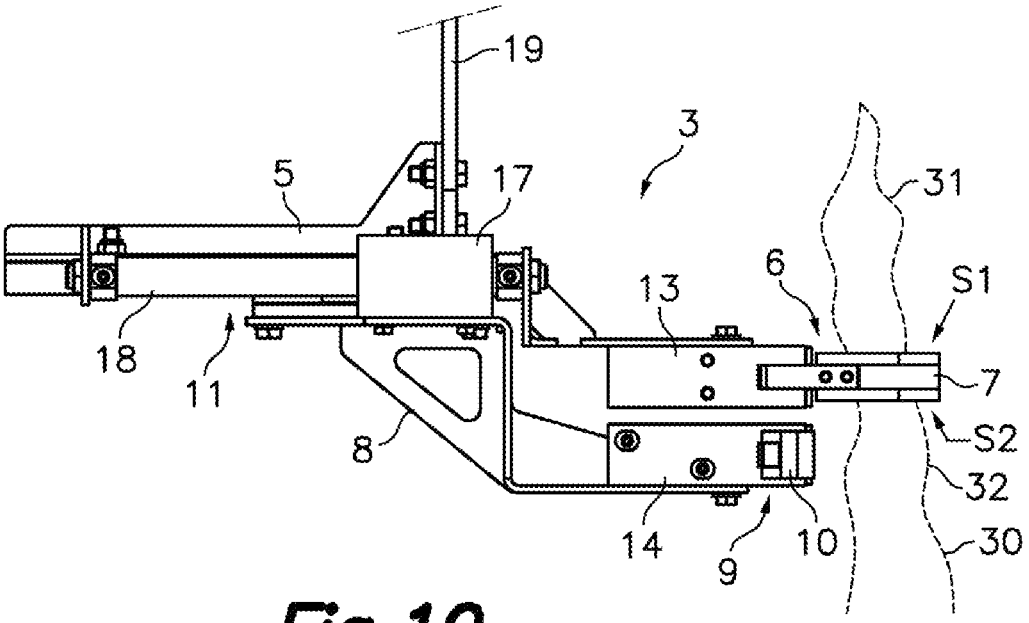
FIGS. 10, 11, 12 and 13 are side views of the clamp assembly showing different successive stages of a repositioning operation in a feeding method according to an embodiment of the present invention carried out by using the feeding device of FIGS. 1 to 9.

As shown in FIG. 10, during a feeding operation, a corner portion of the flatwork textile article 30 is delivered to the main clamp 6 of each clamp assembly 3. When the main jaws 7 of the main clamp 6 are moved to the closed position the main clamps 6 grasps the corner portion of the flatwork textile article 30 such that a protruding corner portion 51 of the flatwork textile article 30 remains at the first side S1 of the clamping pinch of the main jaws 7. Meanwhile, the secondary clamp 9 is placed in the position adjacent to the main clamp 6 at the second side S2 with the secondary jaws 10 in the open position.

Then, the repositioning device is actuated to minimize this protruding corner portion 51 of the flatwork textile article 30 before the spread flatwork textile article 30 is deposited on the feed conveyor 12.

Figure 11:
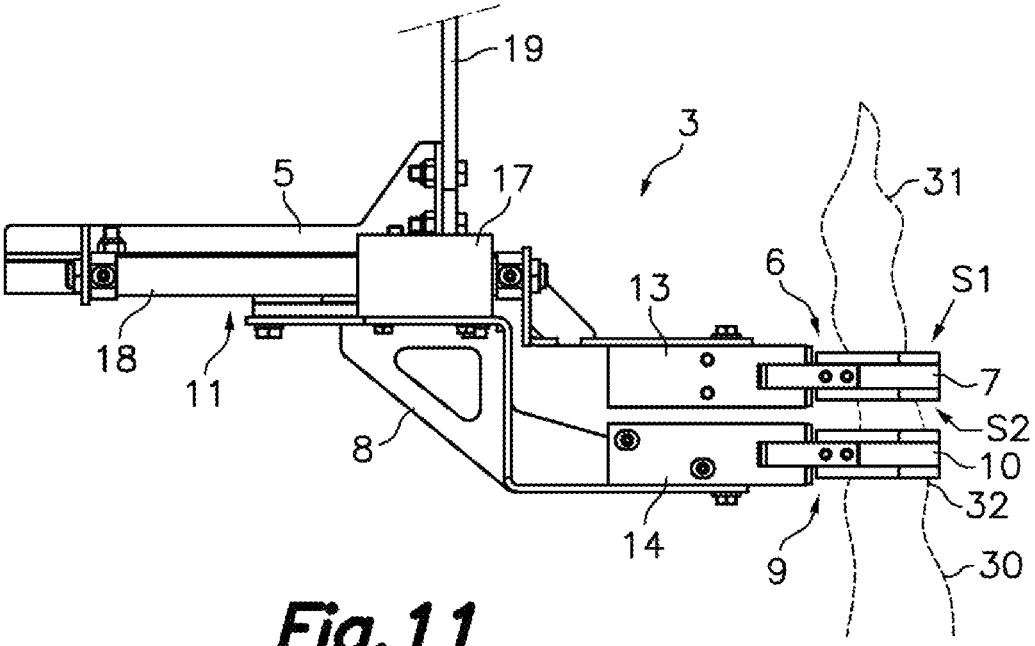

As shown in FIG. 11, once the corner portion of the flatwork textile article 30 is grasped by the main clamp 6 and the secondary clamp 9 is placed at the position adjacent to the main clamp 6, the secondary jaws 10 of the secondary clamp 9 are moved to the closed position thereby grasping a nearby corner portion 32 of the flatwork textile article 30 located at the second side S2 of the clamping pinch of the main jaws 7 and close to the main jaws 7.

Figure 12:
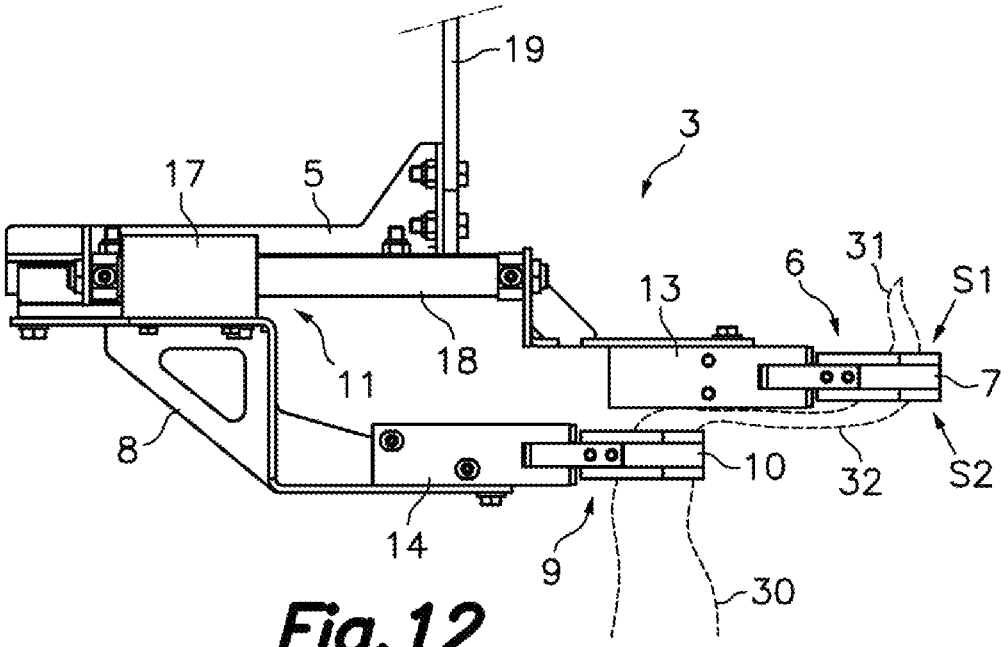

After this, as shown in FIG. 12, the repositioning actuator 11 is activated to move the secondary clamp 9 with the nearby corner portion 32 gasped therein to the position spaced apart from the main clamp 6. With this action, and by virtue of the first frictional force between the main jaws 7 and the flatwork textile article 30 being lower than the second frictional force between the secondary jaws 10 and the flatwork textile article 30, the protruding corner portion 51 of the flatwork textile article 30 is made to slip through the main jaws 7 until the protruding corner portion 51 of the flatwork textile article 30 remaining at the first side S1 of the main site of the main jaws 7 is reduced or minimized to a desired extent.

Figure 13:
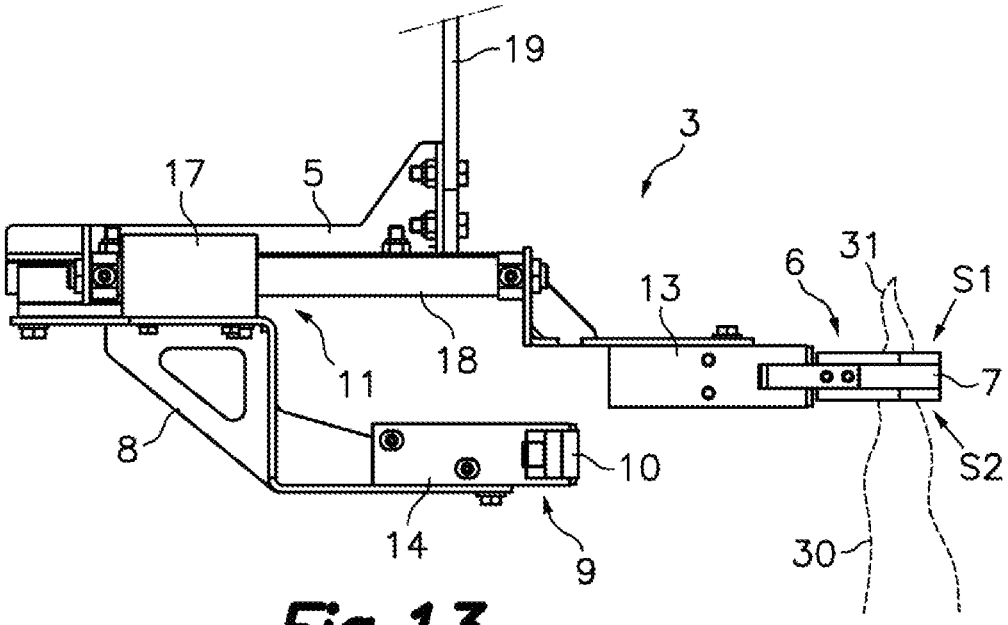

Finally, as shown in FIG. 13, the secondary jaws 10 of the secondary clamp 9 are moved to the open position thereby releasing the nearby corner portion 32 of the flatwork textile article 30 located at the second side S2 of the main jaws 7. With this, the two contiguous corner portions of the flatwork textile article 30 result grasped by the main clamps 6 in such a way that the flatwork textile article 30 can be transferred to the feed conveyor with an improved quality.

What is claimed is:

1. A feeding device for feeding a flatwork textile article to a laundry treatment apparatus, the feeding device comprising:

a feed conveyor arranged to convey a spread flatwork textile article in a feed direction;

a support structure elongated in a transverse direction perpendicular to the feed direction;

transverse guides arranged along the support structure;

a pair of clamp assemblies coupled to the transverse guides and arranged to grasp corner portions of two contiguous corners of the flatwork textile article delivered thereto; and driving elements operatively connected to move the clamp assemblies along the transverse guides in opposite directions to spread the flatwork textile article in order to deposit it on the feed conveyor, wherein each clamp assembly comprises:

a main clamp support;

a main clamp supported on the main clamp support, the main clamp having a pair of main jaws actuated to move between an open position and a closed position to grasp the corresponding corner portion of the flatwork textile article; and a repositioning device actuated reduce or to minimize a protruding corner portion of the flatwork textile article remaining at a first side of a clamping pinch defined by the main jaws in the closed position before the spread flatwork textile article is deposited on the feed conveyor, wherein the repositioning device comprises:

a secondary clamp support movably mounted to the main clamp support;

a secondary clamp supported on the secondary clamp support, the secondary clamp having a pair of secondary jaws actuated to move between an open position and a closed position to grasp a nearby corner portion of the flatwork textile article located at an opposite second side of the clamping pinch of the main jaws in the closed position; and a repositioning actuator arranged to move the secondary clamp support and the secondary clamp between a position adjacent to the main clamp and a position spaced apart from the main clamp, wherein the clamp assembly is configured such that a first frictional force between the main jaws and the flatwork textile article is lower than a second frictional force between the secondary jaws and the flatwork textile article at least during a repositioning operation.

2. The feeding device according to claim 1, wherein the main jaws of the main clamp are driven by a main clamp actuator, the secondary jaws of the secondary clamp are driven by a secondary clamp actuator.

3. The feeding device according to claim 2, wherein a control device is connected to the main clamp actuator and configured to regulate a first clamping force exerted by the main clamp to provide the first frictional force at least during the repositioning operation, and/or the control device is connected to the secondary clamp actuator and configured to regulate a second clamping force exerted by the secondary clamp to provide the second frictional force at least during the repositioning operation.

4. The feeding device according to claim 1, wherein the main jaws of the main clamp comprise opposing first clamping elements made of a first material and/or having a first surface configuration contributing to provide the first frictional force, and the secondary jaws of the secondary clamp comprise opposing second clamping elements made of a second material and/or having a second surface configuration contributing to provide the second frictional force.

5. The feeding device according to claim 2, wherein the main clamp actuator and the secondary clamp actuator are pneumatic actuators.

6. The feeding device according to claim 1, wherein the secondary clamp support is connected to a guide follower coupled to a linear guide attached to the main clamp support.

7. The feeding device according to claim 1, wherein and the repositioning actuator is a pneumatic actuator.

8. A feeding method for feeding a flatwork textile article to a laundry treatment apparatus by means of a feeding device, said feeding device comprising:

a feeding device for feeding a flatwork textile article to a laundry treatment apparatus, the feeding device comprising:

a feed conveyor arranged to convey a spread flatwork textile article in a feed direction;

a support structure elongated in a transverse direction perpendicular to the feed direction;

transverse guides arranged along the support structure;

a pair of clamp assemblies coupled to the transverse guides and arranged to grasp corner portions of two contiguous corners of the flatwork textile article delivered thereto; and driving elements operatively connected to move the clamp assemblies along the transverse guides in opposite directions to spread the flatwork textile article in order to deposit it on the feed conveyor, wherein each clamp assembly comprises:

a main clamp support;

a main clamp supported on the main clamp support, the main clamp having a pair of main jaws actuated to move between an open position and a closed position to grasp the corresponding corner portion of the flatwork textile article; and a repositioning device actuated reduce or to minimize a protruding corner portion of the flatwork textile article remaining at a first side of a clamping pinch defined by the main jaws in the closed position before the spread flatwork textile article is deposited on the feed conveyor, wherein that the repositioning device comprises:

a secondary clamp support movably mounted to the main clamp support;

a secondary clamp supported on the secondary clamp support, the secondary clamp having a pair of secondary jaws actuated to move between an open position and a closed position to grasp a nearby corner portion of the flatwork textile article located at an opposite second side of the clamping pinch of the main jaws in the closed position; and a repositioning actuator arranged to move the secondary clamp support and the secondary clamp between a position adjacent to the main clamp and a position spaced apart from the main clamp, wherein the clamp assembly is configured such that a first frictional force between the main jaws and the flatwork textile article is lower than a second frictional force between the secondary jaws and the flatwork textile article at least during a repositioning operation, the feeding method comprising the steps of:

grasping corner portions of two contiguous corners of a flatwork textile article by moving the main jaws of the main clamps to a closed position;

spreading the flatwork textile article by moving the clamp assemblies in opposite directions along the transverse guides by means of the driving elements;

depositing the spread flatwork textile article on the feed conveyor; and minimizing a protruding corner portion of the flatwork textile article remaining at a first side of a clamping pinch defined by the main jaws of each main clamp in the closed position by means of the repositioning device before the spread flatwork textile article is deposited on the feed conveyor, wherein the step of minimizing the protruding corner portion comprises:

grasping a nearby corner portion of the flatwork textile article located at an opposite second side of the clamping pinch of the main jaws of each main clamp by moving the secondary jaws of each secondary clamp to a closed position;

providing a first frictional force between the main jaws and the flatwork textile article that is lower than a second frictional force between the secondary jaws and the flatwork textile article;

moving the secondary clamp away from the main clamp by means of the repositioning actuator thereby making the protruding corner portion of the flatwork textile article to slip through the main jaws until the protruding corner portion of the flatwork textile article remaining at the first side of the main jaws is reduced to a desired extent; and moving the secondary jaws of the secondary clamp to an open position thereby releasing the nearby corner portion of the flatwork textile article located at the opposite second side of the clamping pinch of the main jaws.

9. The feeding method according to claim 8, wherein the step of providing the first and second frictional forces comprises driving the main jaws of the main clamp by a main clamp actuator, driving the secondary jaws of the secondary clamp by a secondary clamp actuator, and regulating a first clamping force exerted by the main clamp actuator to provide the first frictional force by means of a control device at least during the repositioning operation, and/or regulating a second clamping force exerted by the secondary clamp actuator to provide the second frictional force by means of the control device at least during the repositioning operation.

10. The feeding method according to claim 8, wherein the step of providing the first and second frictional forces comprises providing the main jaws of the main clamp with opposing first clamping elements made of a first material and/or having a first surface configuration which contributes to provide the first frictional force, and providing the secondary jaws of the secondary clamp with opposing second clamping elements made of a second material and/or having a second surface configuration which contributes to provide the second frictional force.

* * * * *